US008418718B2

(12) United States Patent
Hebblethwaite

(10) Patent No.: US 8,418,718 B2
(45) Date of Patent: Apr. 16, 2013

(54) DOUBLE WALLED TANKS WITH INTERNAL CONTAINMENT CHAMBERS

(75) Inventor: Russ Hebblethwaite, Union Bay (CA)

(73) Assignee: Enviro Vault Inc., Union Bay, BC (CA)

( * ) Notice: Subject to any disclaimer, the term of this patent is extended or adjusted under 35 U.S.C. 154(b) by 340 days.

(21) Appl. No.: 12/887,151

(22) Filed: Sep. 21, 2010

(65) Prior Publication Data

US 2011/0168704 A1 Jul. 14, 2011

(30) Foreign Application Priority Data

Sep. 22, 2009 (CA) ..... 2,679,790
Oct. 14, 2009 (CA) ..... 2,682,651

(51) Int. Cl.
*B65D 88/54* (2006.01)
*B65D 90/10* (2006.01)

(52) U.S. Cl.
USPC ..... 137/584; 137/143; 137/312; 137/559; 137/590; 220/565; 220/567.2

(58) Field of Classification Search ..... 137/143, 137/312, 559, 584, 590, 590.5; 220/565, 220/567.2, 62.18
See application file for complete search history.

(56) References Cited

U.S. PATENT DOCUMENTS 2,252,173 A * 8/1941 Lowell ..... 137/208
2,563,118 A * 8/1951 Jackson ..... 220/560.03
3,608,768 A * 9/1971 McGrath ..... 220/565
4,019,583 A * 4/1977 Simon ..... 220/88.3
4,131,785 A 12/1978 Shutt
4,519,415 A * 5/1985 Carn ..... 220/565
4,803,343 A 2/1989 Sotani et al.
5,038,456 A * 8/1991 McGarvey ..... 220/560.01
5,071,166 A * 12/1991 Marino ..... 220/560.03
5,139,390 A 8/1992 Rajewski
5,154,312 A * 10/1992 Robbins ..... 220/724
5,197,627 A 3/1993 Disabato et al.
5,259,895 A 11/1993 Sharp
5,381,923 A * 1/1995 O'Dea ..... 220/565
5,960,826 A * 10/1999 Hebblethwaite et al. ..... 137/551
5,971,009 A 10/1999 Schuetz et al.
6,318,581 B1 11/2001 Garton
6,516,754 B2 2/2003 Chadwick
7,165,572 B2 1/2007 Hebblethwaite
7,314,058 B2 1/2008 Saito
8,328,040 B2 * 12/2012 Ries ..... 220/562

FOREIGN PATENT DOCUMENTS

CA 2169126 8/1997
CA 2196842 12/2000
CA 2609642 5/2009
CA 2675482 2/2011
WO 2011/035429 3/2011
WO 2011/069260 6/2011

* cited by examiner

*Primary Examiner* — John Rivell
(74) *Attorney, Agent, or Firm* — Bennett Jones LLP

(57) ABSTRACT

A double-walled above-ground storage tank includes a primary tank and a secondary tank, and an interstitial space; an containment chamber formed by a primary chamber wall and a secondary chamber wall, forming a chamber interstitial space therebetween, and an exterior door assembly; and at least one pipe and valve assembly wherein the pipe originates in the tank interior volume and the valve is disposed within the chamber.

13 Claims, 17 Drawing Sheets

DOUBLE WALLED TANKS WITH INTERNAL CONTAINMENT CHAMBERS

CROSS REFERENCE TO RELATED APPLICATIONS

This application claims the priority of Canadian Patent Application No. 2,679,790 filed on Sep. 22, 2009 entitled "Double Walled Tanks with Internal Containment Chambers", and Canadian Patent Application No. 2,682,651 filed on Oct. 14, 2009 entitled "Double Walled Tanks with Internal Containment Chambers", the contents of which are incorporated herein by reference.

FIELD OF INVENTION

The present invention is directed to double walled storage tanks with internal containment chambers.

BACKGROUND

The storage of materials, including petroleum products and waste materials, in the upstream petroleum industry is dependent on primary containment devices, such as underground and aboveground storage tanks. Such tanks typically include secondary containment measures, which are required in some jurisdictions.

In Alberta, a single-walled aboveground storage tank must have secondary containment consisting of a dike with an impervious liner. However, the regulations permit the use of double-walled aboveground storage tanks ("DW ASTs") as an alternative to single-walled aboveground tanks and a secondary containment system. However, it has been found that DW ASTs are typically configured with manways and piping through the walls of the tanks. A majority of spills or releases from tanks are the result of operational issues such as overfilling, leaks and drips from valves and fittings, and spillage associated with fluid transfer. These releases are not being contained by the double-wall interstitial space.

The use of an internal containment chamber within single walled tanks is known. Applicant's CA Patent No. 2,196,842 and U.S. Pat. No. 5,960,826 disclose the use of such containment chambers to contain spills and overflows from various valves used in these tanks.

SUMMARY OF THE INVENTION

In one aspect, the invention comprises an above-ground storage tank comprising:

(a) a tank roof, a tank floor, a primary tank and a secondary tank, which together define a tank interstitial space therebetween;

(b) a containment chamber formed by a primary chamber wall and a secondary chamber wall, which together define a chamber interstitial space therebetween, and an exterior door assembly;

(c) wherein the primary tank, the primary chamber wall and the tank floor together define a tank interior volume;

(c) at least one pipe and valve assembly wherein the pipe originates in the tank interior volume and the valve is disposed within the chamber;

(d) wherein the at least one pipe and valve assembly does not pass through the primary tank or the primary chamber wall in a non-freeboard zone.

In one embodiment, the at least one pipe and valve assembly passes into the chamber without passing through the primary tank at all, or passes through the primary tank in a freeboard zone and into the containment chamber from the tank interstitial space, or passes through the primary and secondary tank in a freeboard zone and into the chamber through the exterior door assembly.

The configuration of the containment chamber and the at least one pipe and valve assembly is arranged such that the double-walled protection of the tank is not compromised by any pipe or hatch or other opening, except in the freeboard zone.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The invention relates to double-walled aboveground storage tanks. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

In one embodiment, the invention comprises an above-ground storage tank defining an interior volume and having an internal containment chamber. The tank itself is double-walled, as is the containment chamber. All pipe and valve assemblies which penetrate into the tank are configured so as to not compromise either the interstitial space of the tank or the containment chamber. In one embodiment, the interstitial space of the tank is not compromised because the primary tank is not penetrated, or is only penetrated in the freeboard zone of the tank. As used herein, the term "freeboard" means that area of the tank above the highest fluid level of the tank, or an area which is normally not in contact with fluid in the tank.

Therefore, in one embodiment, the invention comprises an above-ground storage tank comprising:

(a) a tank roof, a tank floor, a primary tank and a secondary tank, which together define a tank interstitial space therebetween;

(b) a containment chamber formed by a primary chamber wall and a secondary chamber wall, which together define a chamber interstitial space therebetween, and an exterior door assembly;

(c) wherein the primary tank, the primary chamber wall and the tank floor together define a tank interior volume (c) at least one pipe and valve assembly wherein the pipe originates in the tank interior volume and the valve is disposed within the chamber;

(d) wherein the at least one pipe and valve assembly does not pass through the primary tank or the primary chamber wall in a non-freeboard zone.

In one embodiment, the at least one pipe and valve assembly passes into the chamber without passing through the primary tank at all, or passes through the primary tank in a freeboard zone and into the containment chamber from the tank interstitial space, or passes through the primary and secondary tank in a freeboard zone and into the chamber through the exterior door assembly.

Figure 1:
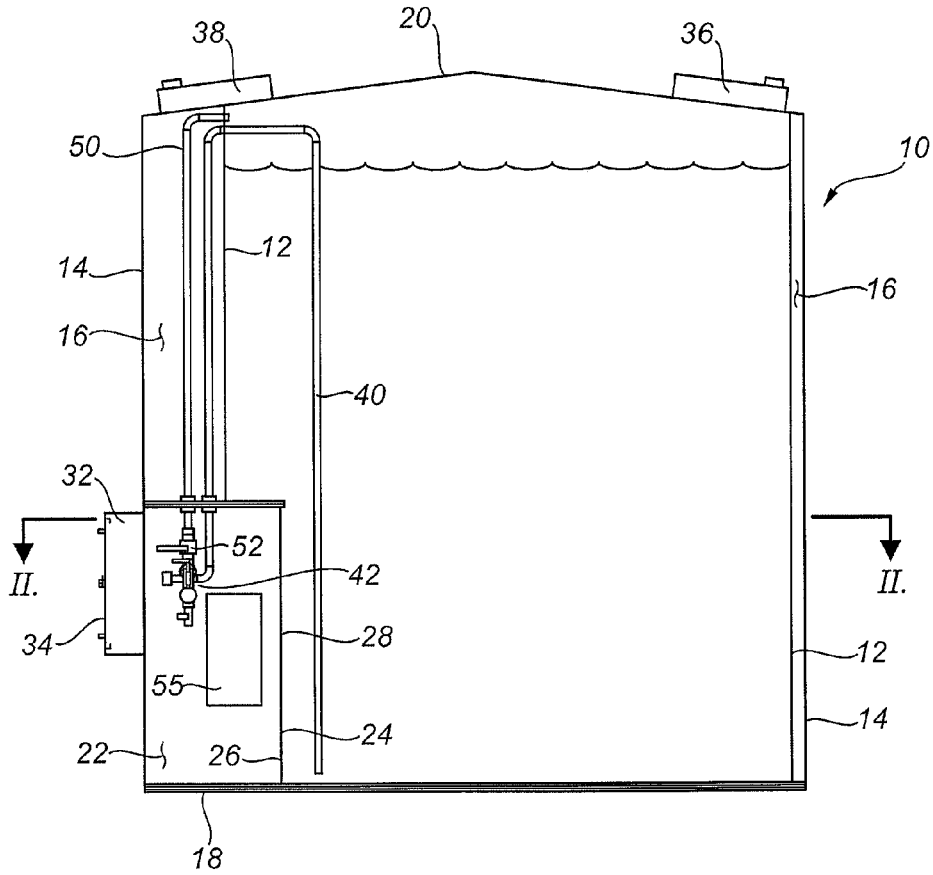
FIG. 1 shows a vertical cross-section through one embodiment of a tank of the present invention.
Figure 2:
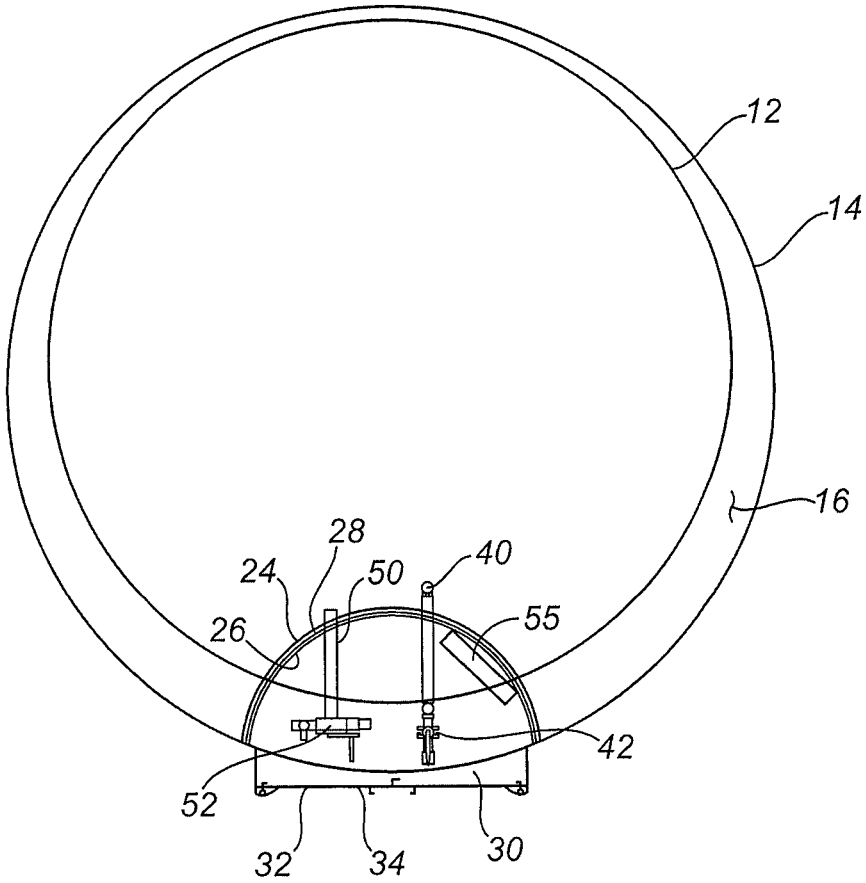
FIG. 2 shows a horizontal cross-section through the embodiment shown in FIG. 1, along line II-II.

As shown in FIGS. 1 and 2, in one embodiment, a storage tank (10) has an inner primary tank (12), and an outer secondary tank (14), which defines a tank interstitial space (16) therebetween. As required by regulation in Alberta, the floor (18) is also double-walled, while the roof (20) is not as it is considered part of the freeboard zone of the tank.

An internal containment chamber (22) is created by a chamber primary wall (24) and a chamber secondary wall (26), which together define a chamber interstitial space (28). The primary chamber wall (24) is that wall which faces the tank interior volume, while the secondary chamber wall (26) is that wall facing inside the chamber (22). The chamber walls (24, 26) are attached to the tank walls (12, 14) in a fluid-tight manner, such as by a suitable welding process. The attachments between the tank and containment chamber primary and secondary walls may be varied, as will be described below. What is essential is that the tank interstitial space and chamber interstitial space not be compromised.

Access to the containment chamber (22) is provided by a door assembly (30) which passes through the secondary tank wall (14). The door assembly may comprise a box (32) having a door (34). The door assembly can either be formed from the tank secondary wall material, or, be a completely separate manufactured component that is welded to the exterior of the tank secondary wall, over a door opening cut through both secondary and primary walls. The door opening must then be framed between the primary and secondary tank walls to re-seal the interstitial space. This doorway opening provides access into the containment chamber.

A tank access hatch (36) may be provided through the tank roof (20). A pipe access hatch (38) may be also be provided which provides access the interstitial space, tank volume or chamber space which houses pipe and valve assemblies, as described below.

The tank comprises at least one pipe and valve assembly. In one embodiment, the tank comprises two pipe and valve assemblies: a suckout pipe (40) and an overflow pipe (50). The suckout pipe (40) originates near the tank floor, rises to the freeboard zone (F), where it passes through the primary tank wall (12) and into the tank interstitial space (16). It then passes through the containment chamber walls and into the containment chamber, where it terminates with a suckout valve (42).

An overflow pipe (50) originates in the freeboard zone, near the fluid line marking maximum capacity of the tank, and passes into the tank interstitial space (16). The overflow pipe (50) then continues into the containment chamber, and terminates in a high level shutdown valve (52). This valve (52) may include sensors which regulate inflows into the tank, or may be connected to transmitters (not shown) which transmit a wireless or radio alarm signal, as is well known in the art. As fluid in the tank exceeds the maximum capacity, a small amount of fluid will flow into the overflow pipe, and into the high level shutdown valve. Sensors in the valve may detect fluid, and cause inflows into the tank to stop. In another embodiment, there may be fluid connections from either or both the tank interstitial space or the chamber interstitial space to the high level shutdown valve. Accordingly, fluid in either interstitial space, which means that the primary tank or primary chamber wall has been breached, will cause an alarm signal or shutdown of inflows, or both.

As may be seen in FIGS. 1 and 2, both the suckout pipe (40) and valve (42) assembly and the overflow pipe (50) and valve (52) assembly do not compromise the integrity of the interstitial space, as they pass into the interstitial space in the freeboard zone, and then directly into the containment chamber, which is itself double-walled.

A heater (55) may be provided within the containment chamber to keep the valves (42, 52) from freezing in the winter.

Figure 3:
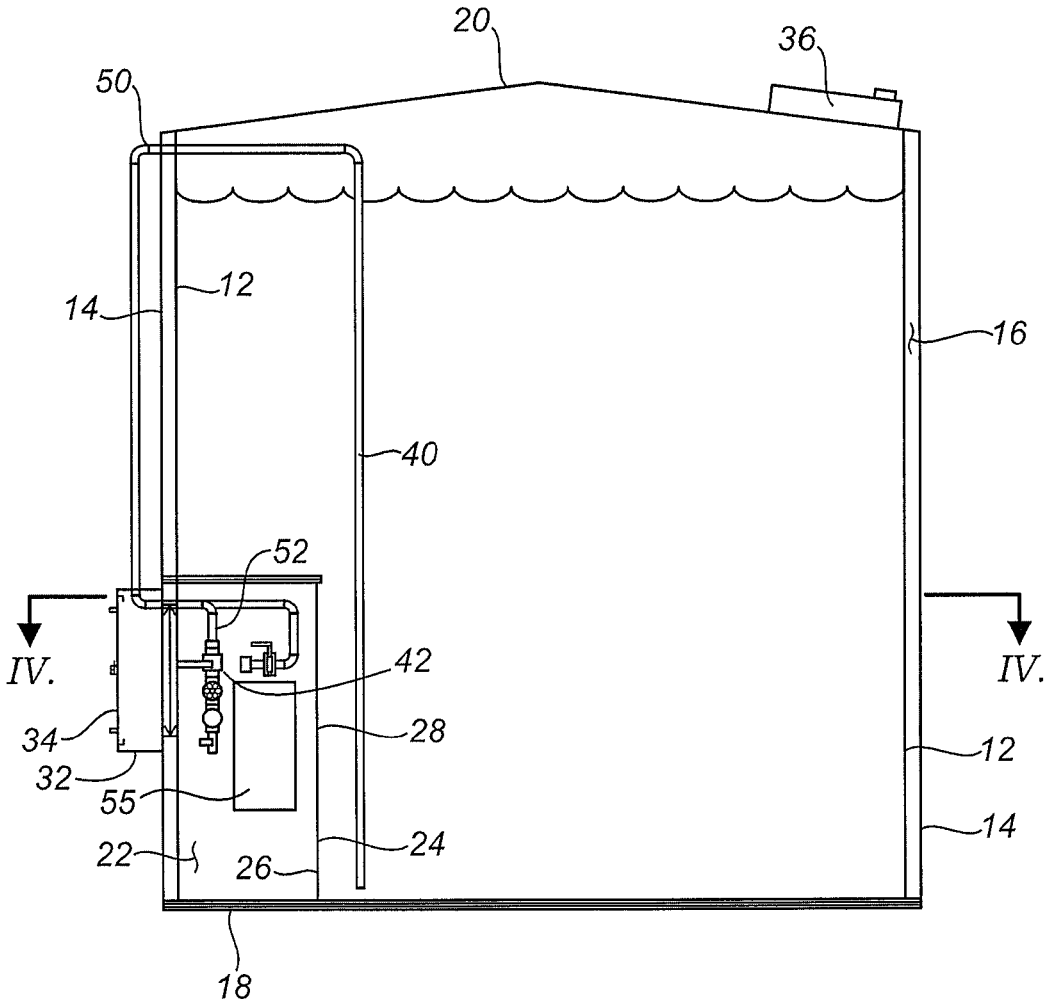
FIG. 3 shows a vertical cross-section through an alternative embodiment of a tank of the present invention.
Figure 4:
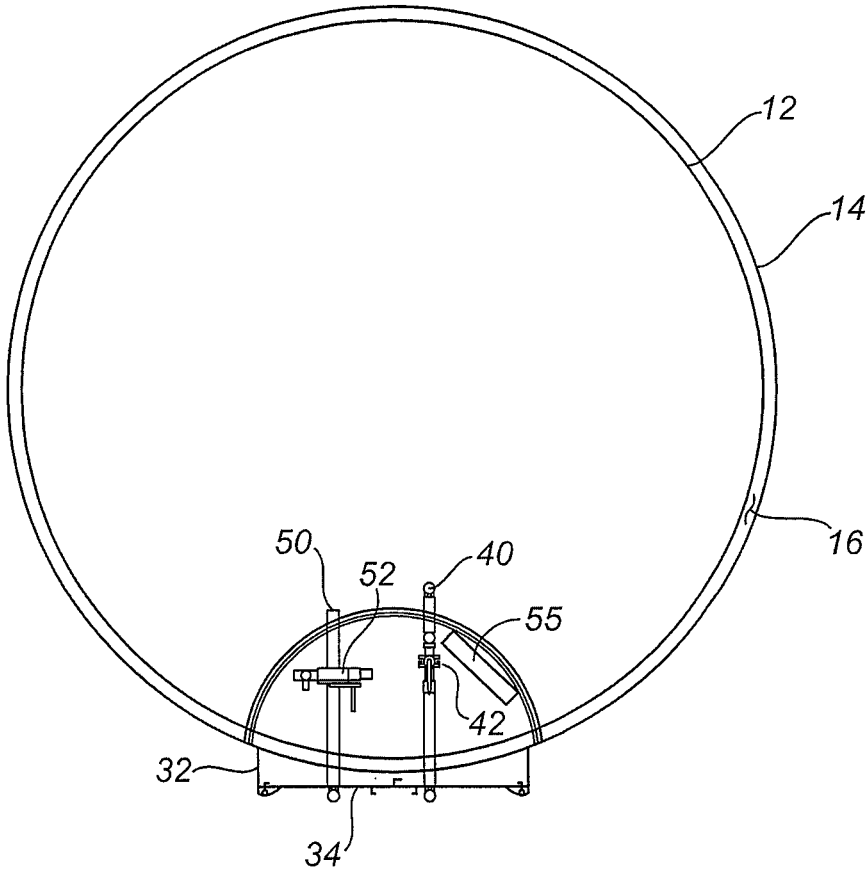
FIG. 4 shows a horizontal cross-section through the embodiment shown in FIG. 3, along line IV-IV.

In an alternative embodiment, as shown in FIGS. 3 and 4, the pipes (40, 50) pass through both the primary and secondary tank walls in the freeboard zone. The pipes then pass along the exterior of the tank, and enter into the containment chamber through the door box (32). Because the pipes are accessible on the exterior of the tank, in this embodiment, a pipe access hatch into the tank is not necessary.

Figure 5:
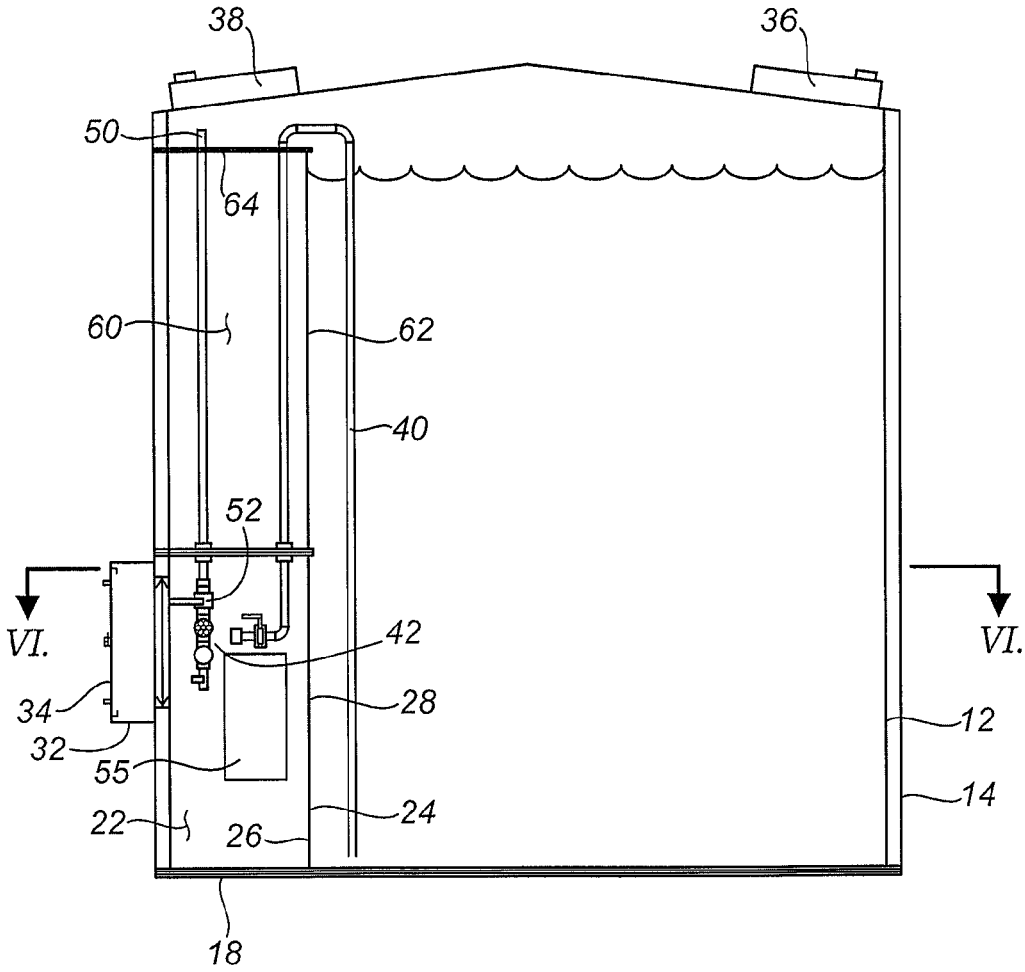
FIG. 5 shows a vertical cross-section through an alternative embodiment of a tank of the present invention.
Figure 6:
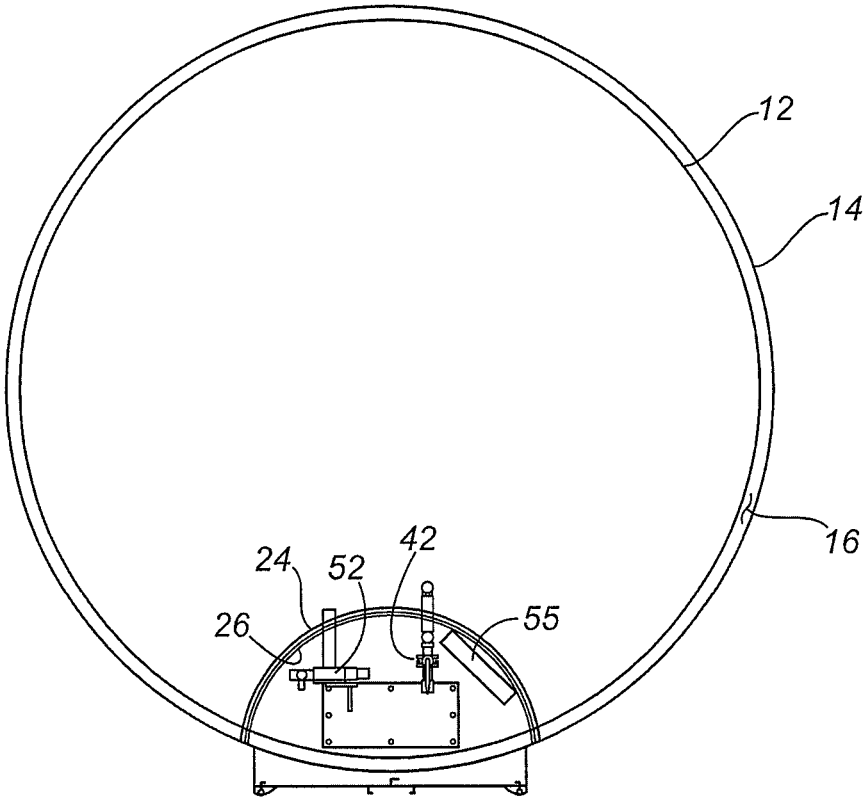
FIG. 6 shows a horizontal cross-section through the embodiment shown in FIG. 5, along line VI-VI.

In an alternative embodiment, shown in FIGS. 5 and 6, the tank comprises an ancillary containment chamber (60) formed by a single walled enclosure (62). The ancillary chamber is formed adjacent to the main containment chamber and has a roof portion (64). The pipes (40, 50) pass into the ancillary chamber, preferably but not necessarily in the freeboard zone, and from there, pass into the main containment chamber. The overflow pipe (50) simply extends up through the roof portion (64). Because the single walled enclosure is ancillary to the double walled tank and containment chamber, the incursions into the interstitial spaces are contained by the ancillary chamber.

Figure 7:
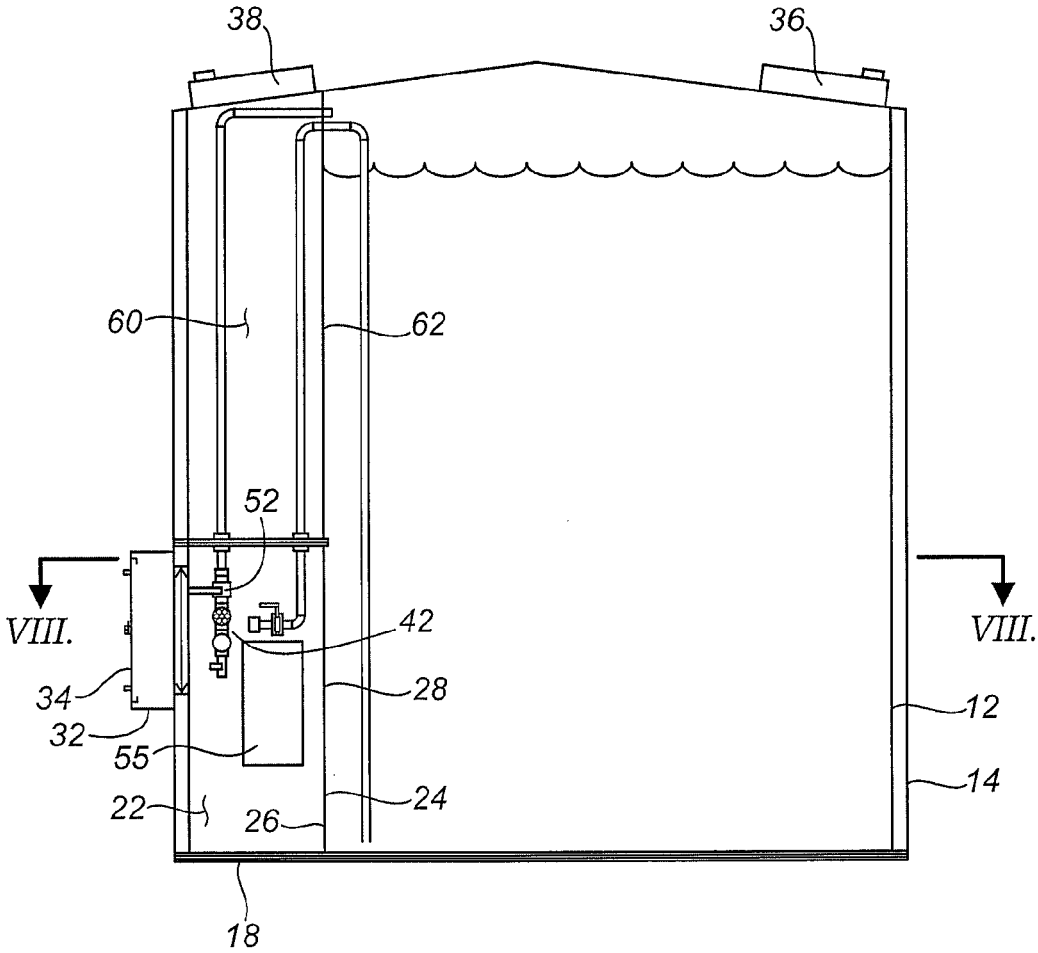
FIG. 7 shows a vertical cross-section through an alternative embodiment of a tank of the present invention.
Figure 8:
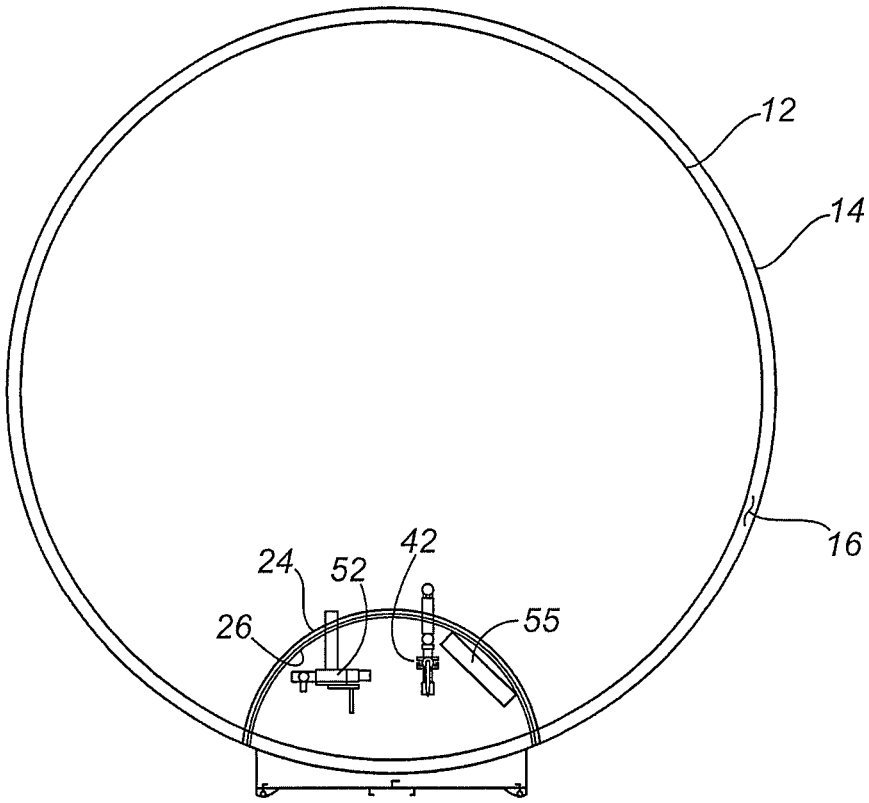
FIG. 8 shows a horizontal cross-section through the embodiment shown in FIG. 7, along line VIII-VIII.

In a further alternative embodiment, as shown in FIGS. 7 and 8, the single walled enclosure (62) of the ancillary chamber extends upwards and attaches to the tank roof (20). The access hatch (38) through the tank roof (20) provides direct access into the ancillary chamber, unlike the embodiment shown in FIGS. 5 and 6, where the pipe access hatch (38) only provides access to the roof portion (64) of the ancillary chamber.

Figure 9:
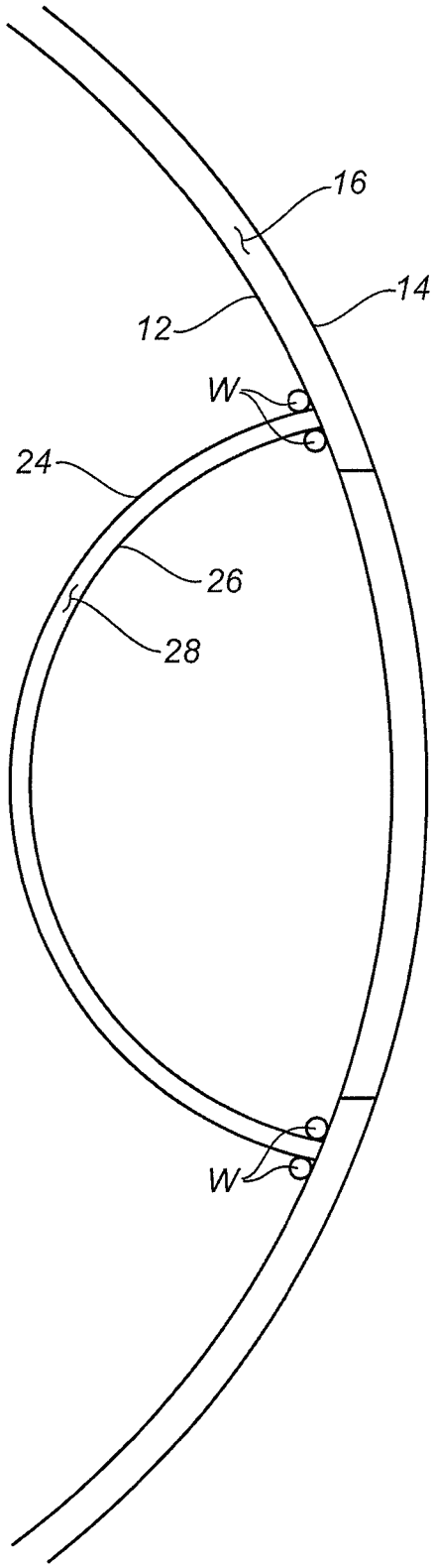
FIG. 9 shows one embodiment of the configuration of welds connecting the primary and secondary tank walls to the primary and secondary chamber walls.
Figure 10:
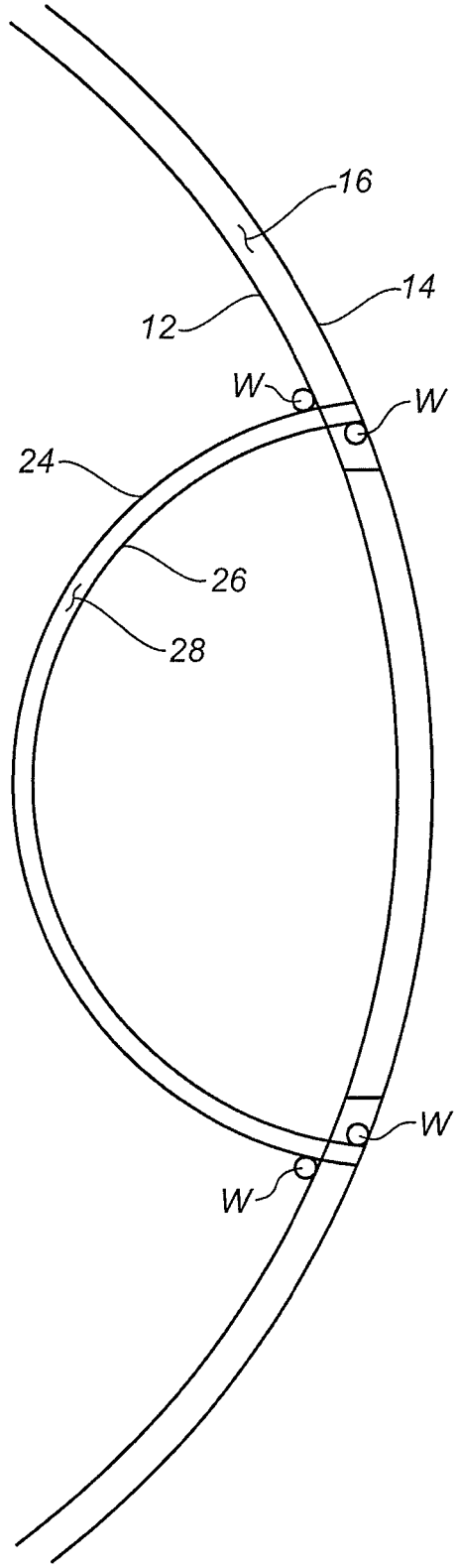
FIG. 10 shows an alternative embodiment of the configuration of welds connecting the primary and secondary tank walls to the primary and secondary chamber walls.
Figure 11:
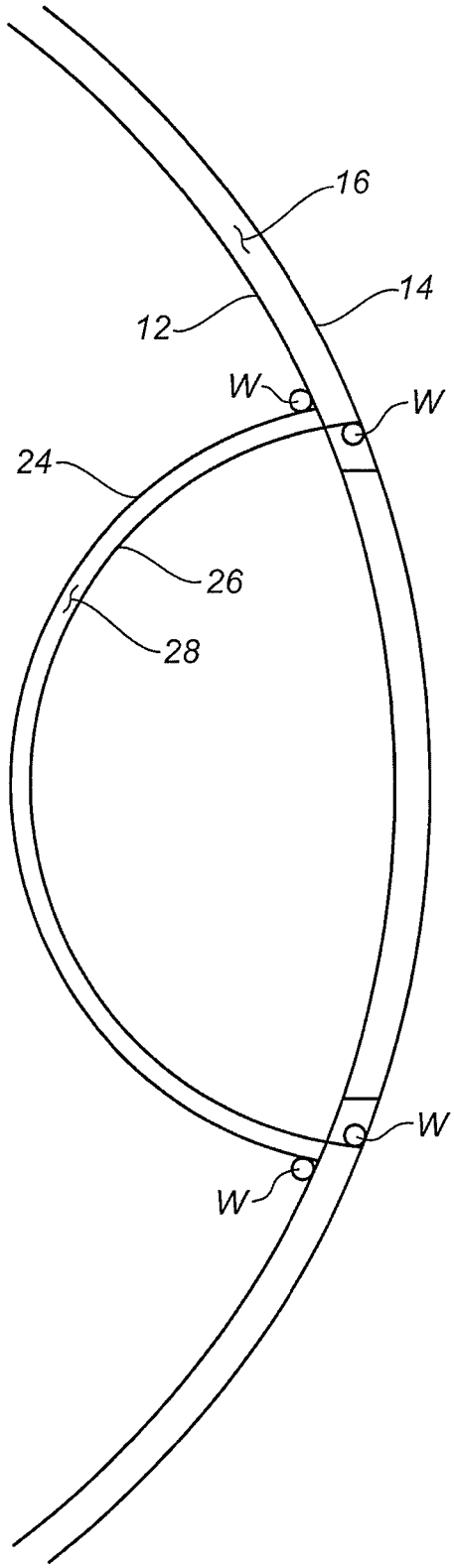
FIG. 11 shows an alternative embodiment of the configuration of welds connecting the primary and secondary tank walls to the primary and secondary chamber walls.

As shown in FIGS. 9, 10 and 11, various configurations of attachment between the tank primary and secondary walls and the chamber primary and secondary walls are possible. Both of the primary or secondary chamber walls (24, 26) may attach to the primary tank wall, as is shown in FIG. 9. In this case, the tank interstitial space and the chamber interstitial space are separated by the primary tank wall. In one embodiment, the attachment is accomplished by a full penetration weld (W) which is fluid-tight.

Alternatively, the primary chamber wall (24) may attach to the primary tank wall (12), while secondary chamber wall (26) attachs to the secondary tank wall (14). In one embodiment, shown in FIG. 10, the primary chamber wall is welded to the primary tank wall in a fluid tight manner, and the secondary chamber wall is welded to the secondary tank wall. As a result, the tank interstitial space (16) is contiguous with the chamber interstitial space (FIG. 11). Alternatively, there is no sealed connection between the two (FIG. 10), which means the two interstitial spaces are connected but not contiguous.

Figure 12:
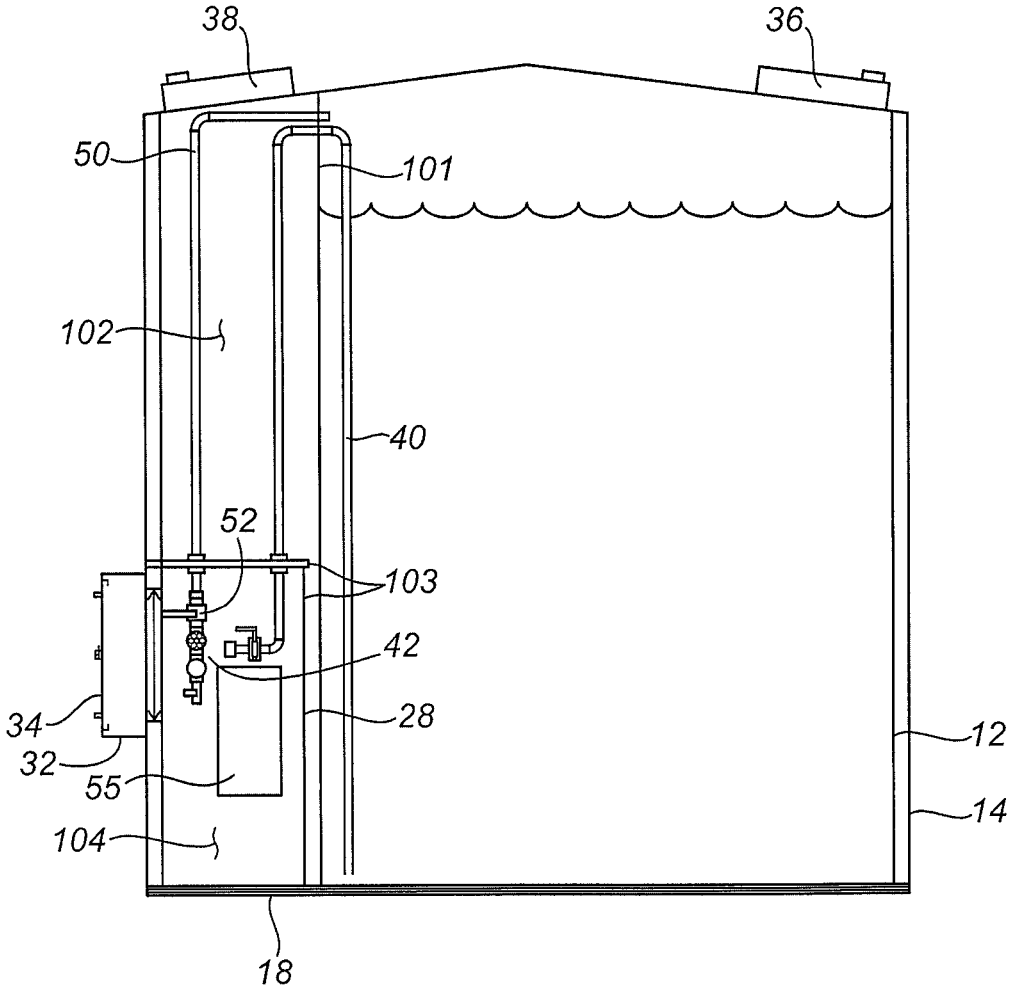
FIG. 12 shows a vertical cross-section through an alternative embodiment of a tank of the present invention.
Figure 14:
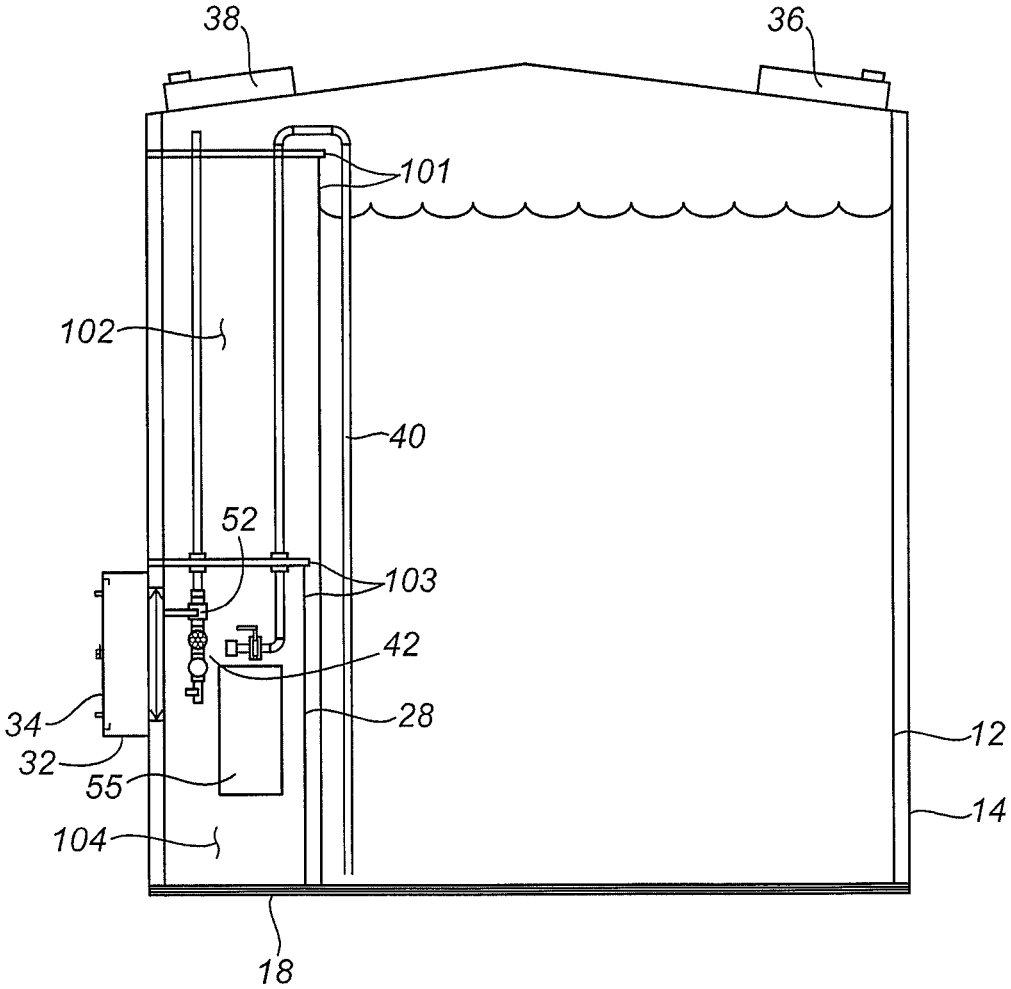
FIG. 14 shows a vertical cross-section through an alternative embodiment of a tank of the present invention.

In an alternative embodiment, two single walled chambers may be used in place of a dual-walled chamber. This implementation may provide more convenient installation or retrofitting possibilities in some cases. As shown in FIG. 12, a first or primary chamber wall (101) is installed so as to surround a secondary chamber wall (103) and extends all the way to the tank roof. The pipes (40, 50) pass through the primary chamber wall (101) and into the first chamber (102) and then into a second chamber (104) through the secondary chamber wall. Preferably, the pipes (40, 50) pass through the primary chamber wall (101) in the freeboard zone. Thus, the first chamber created between the first and second chamber walls provides the equivalent of an interstitial space and may contain any spills or leaks from the tank and from the pipe fittings, while the second chamber corresponds to the containment chamber in the embodiments described above. In one variation, the first single walled chamber (101) does not extend all the way to the roof, only to the freeboard zone of the tank. The chamber thus has a roof section (105) through which the pipes (40, 50) may pass, as shown in FIGS. 14 and 15.

Figure 16:
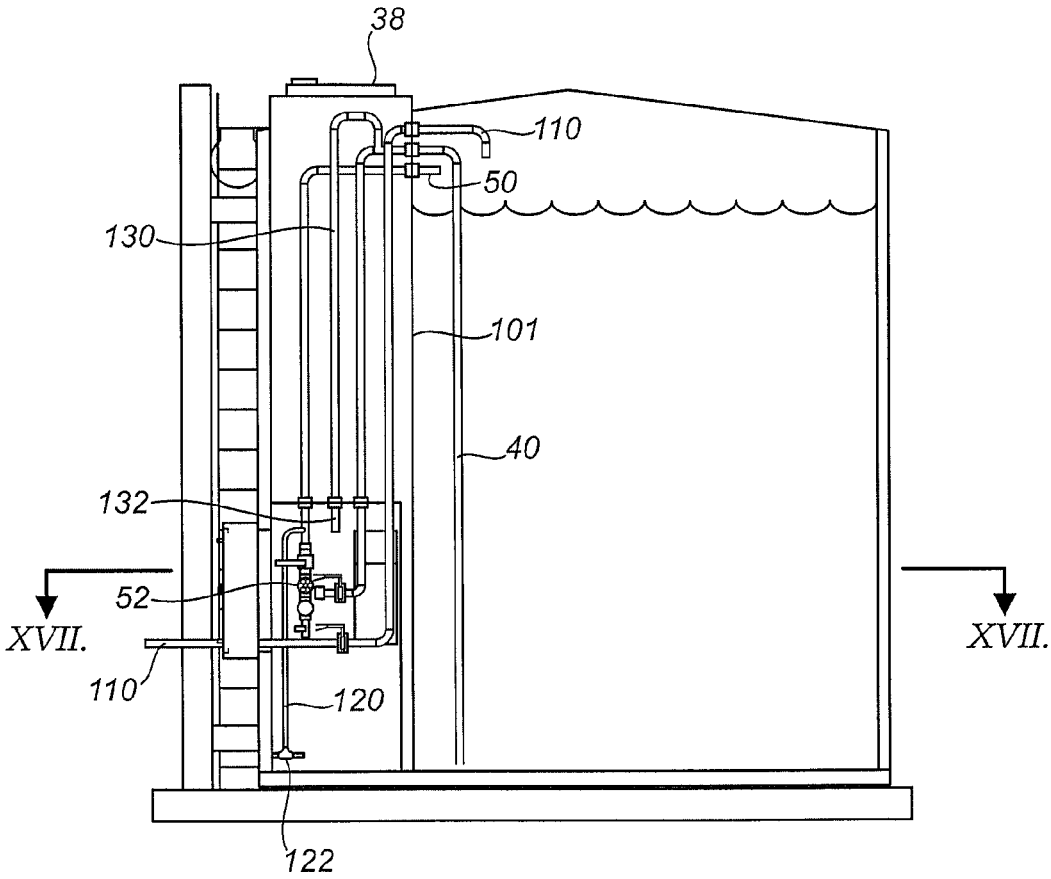
FIG. 16 shows a vertical cross-section through an alternative embodiment of a tank of the present invention.
Figure 17:
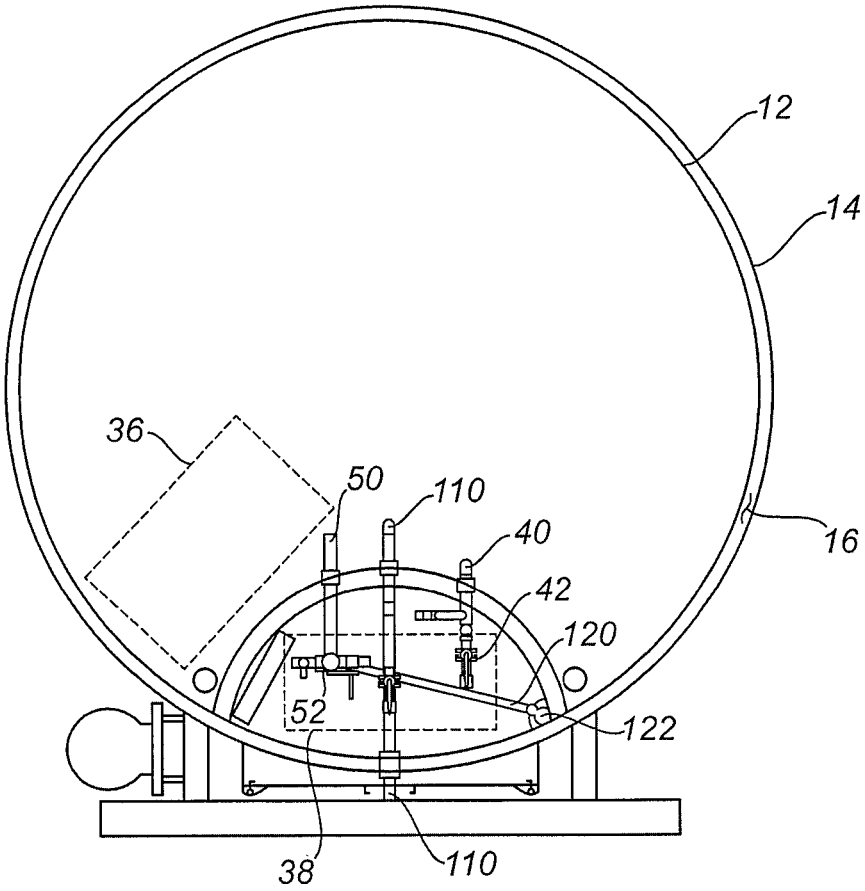
FIG. 17 shows a horizontal cross-section through the embodiment shown in FIG. 9, along line XVII-XVII.

In a further alternative, the primary chamber wall (101) extends up through the tank roof, with an access hatch as shown in FIGS. 16 and 17. Additional features are shown in this example, which may also be included with any embodiment of the invention. An inlet pipe (110) passes through the chamber door into the chamber, upwards through the secondary chamber wall (103), and finally into the tank through the primary chamber wall (12) in the freeboard zone. An overflow pipe (50) connects to a high level shut down valve (52) as described above.

A suck out pipe (40) and valve (42) may also provided as described above. In one embodiment, a siphon break (130) is connected to the suck out pipe (30) and terminates with a siphon valve (132) in the containment chamber.

Figure 13:
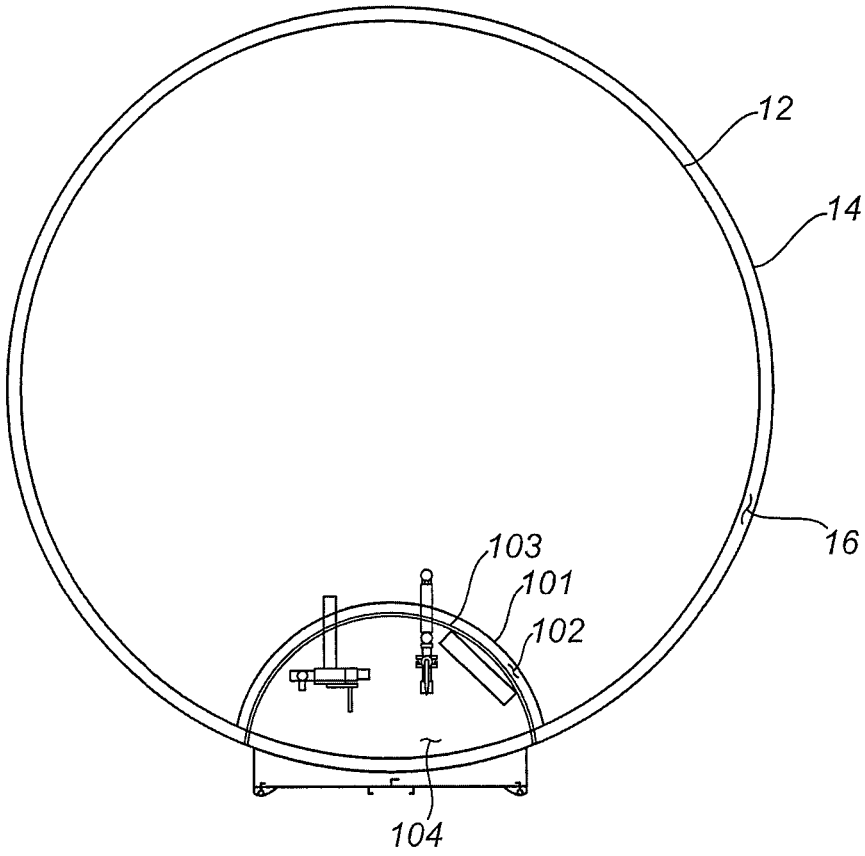
FIG. 13 shows a horizontal cross-section through the embodiment shown in FIG. 12, along line XIII.
Figure 15:
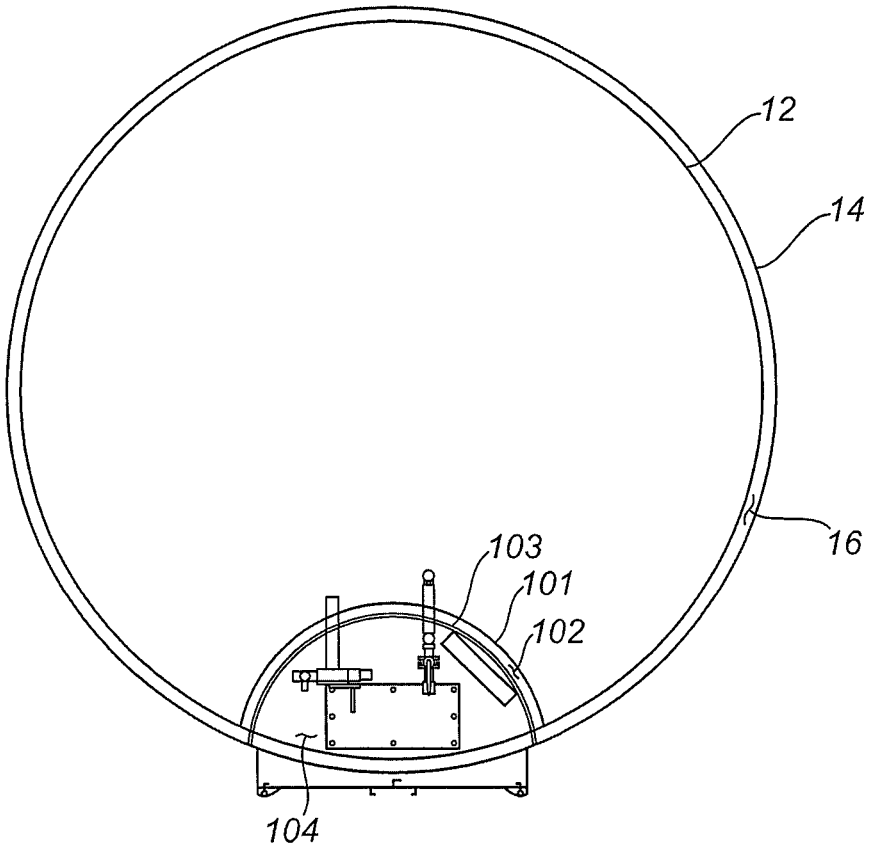
FIG. 15 shows a horizontal cross-section through the embodiment shown in FIG. 14, along line XV.

As shown in FIGS. 13 and 15, the primary chamber wall (101) may be welded to the primary tank wall, while the secondary chamber wall (103) may be welded to the secondary tank wall. Alternatively, both primary and secondary chamber walls may be welded to the primary tank, as shown in FIG. 17. The same variations of welding patterns described above may apply to these embodiments. As may be appreciated by those skilled in the art, an existing double walled tank having a single walled containment chamber may be easily retrofitted with a primary chamber wa;;)1-1_. The first single walled chamber may be welded into the tank in sections to facilitate installation. For example, a lower piece and an upper piece may be installed, leaving a middle section open to allow access to the containment chamber and tank interior. Once all welds have been finished and all piping installed, then a middle piece or pieces may be installed to complete the primary chamber wall.

In one embodiment, the tank comprises fluid detection sensors (not shown) in the tank interstitial space, the chamber interstitial space, or both. If the tank interstitial space, and the chamber interstitial space are connected or continguous, it may possible to implement only one fluid detection sensor within either the tank or the chamber interstitial space. Suitable fluid detection sensors are well known in the art. In one embodiment, an interstitial connect (120) may be provided which provides a fluid connection between either or both of the tank interstitial space and the chamber interstitial space and the high level shut down valve (52). The interstitial connect (120) may be transparent or translucent to enable visual confirmation of fluid in the connect (120). The bottom end of the connect may terminate in a "Y" connector (122) to connect both the tank and chamber interstitial spaces.

As will be apparent to those skilled in the art, various modifications, adaptations and variations of the foregoing specific disclosure can be made without departing from the scope of the invention claimed herein.

What is claimed is:

1. An above-ground storage tank comprising:

(a) a tank roof, a tank floor, a primary tank and a secondary tank, which together define a tank interstitial space therebetween;

(b) a containment chamber formed by a primary chamber wall and a secondary chamber wall, which together define a chamber interstitial space therebetween, and an exterior door assembly;

(c) wherein the primary tank, the primary chamber wall and the tank floor together define a tank interior volume (c) at least one pipe and valve assembly wherein the pipe originates in the tank interior volume and the valve is disposed within the chamber;

(d) wherein the at least one pipe and valve assembly does not pass through the primary tank or the primary chamber wall in a non-freeboard zone.

2. The tank of claim 1, wherein the at least one pipe and valve assembly passes into the chamber without passing through the primary tank at all, or passes through the primary tank in a freeboard zone and into the containment chamber from the tank interstitial space, or passes through the primary and secondary tank in a freeboard zone and into the chamber through the exterior door assembly.

3. The tank of claim 1 wherein the tank roof comprises an access hatch.

4. The tank of claim 1 wherein the at least one pipe and valve assembly comprises a one or more of a tank inlet pipe and valve, a tank suckout pipe and valve, or a tank overflow pipe and high level shut down valve.

5. The tank of claim 1 wherein the tank interstitial space and the chamber interstitial space are contiguous or connected.

6. The tank of claim 4 further comprising an interstitial connect disposed within the chamber, providing a fluid connection between the tank interstitial space or the chamber interstitial space, or both, and the high level shut down valve.

7. The tank of claim 6 wherein the interstitial connect is transparent or translucent to provide visual confirmation of the presence of absence of fluid in the interstitial connect.

8. The tank of claim 4 further comprising a siphon break connected to the suck out pipe, and a siphon valve disposed within the chamber.

9. The tank of claim 2 wherein the tank roof comprises an access hatch.

10. The tank of claim 2 wherein the at least one pipe and valve assembly comprises a one or more of a tank inlet pipe and valve, a tank suckout pipe and valve, or a tank overflow pipe and high level shut down valve.

11. The tank of claim 10 further comprising an interstitial connect disposed within the chamber, providing a fluid connection between the tank interstitial space or the chamber interstitial space, or both, and the high level shut down valve.

12. The tank of claim 11 wherein the interstitial connect is transparent or translucent to provide visual confirmation of the presence of absence of fluid in the interstitial connect.

13. The tank of claim 10 further comprising a siphon break connected to the suck out pipe, and a siphon valve disposed within the chamber.

* * * * *